United States Patent [19]

Heffer

[11] Patent Number: 5,036,828

[45] Date of Patent: Aug. 6, 1991

[54] TARGET MAGAZINE

[76] Inventor: Brian A. Heffer, Lawson Road, Barham, New South Wales, Australia

[21] Appl. No.: 542,684

[22] Filed: Jun. 25, 1990

Related U.S. Application Data

[63] Continuation of Ser. No. 35,733, filed as PCT AU86/00233 on Aug. 15, 1986, published as WO87/01191 on Feb. 26, 1987.

[30] Foreign Application Priority Data

Aug. 15, 1985 [AU] Australia ..... PH01955

[51] Int. Cl.[5] ..... F41J 9/18

[52] U.S. Cl. ..... 124/47; 124/8; 221/122

[58] Field of Search ..... 124/8, 6, 43, 42, 46–48, 124/51.1; 221/113, 119, 121, 122

[56] References Cited

U.S. PATENT DOCUMENTS

| | | | |
|---|---|---|---|
| 2,310,746 | 2/1943 | Parker et al. | 124/8 |
| 2,711,726 | 6/1955 | Darrell | 124/6 |
| 2,827,036 | 3/1958 | Ervine et al. | 221/113 X |
| 3,351,232 | 11/1967 | Anderson | 221/122 X |
| 3,937,203 | 2/1976 | Riedmueller et al. | 124/43 X |
| 4,005,695 | 2/1977 | Alday et al. | 124/8 |
| 4,558,802 | 12/1985 | Molison | 221/122 X |

FOREIGN PATENT DOCUMENTS

| | | | |
|---|---|---|---|
| 2952527 | 7/1981 | Fed. Rep. of Germany | 124/47 |
| 2334081 | 7/1977 | France | 124/47 |
| 2419500 | 11/1979 | France | 124/47 |

*Primary Examiner*—Peter M. Cuomo

*Attorney, Agent, or Firm*—Lowe, Price, Leblanc & Becker

[57] ABSTRACT

A magazine for targets to be thrown from a throwing device having a rotatable throwing arm mounted for rotation with a shaft is disclosed. The magazine comprises a stationary plate having a transfer opening therein and a holding member for holding a plurality of columns of targets. The columns are supported by this stationary plate except at the transfer opening. An indexing mechanism selectively rotates the holding member about the shaft in synchronism with the throwing arm so that when one of the columns passes over the transfer opening, the lowermost target in the column passes through the opening and onto the throwing arm. The indexing mechanism is arranged to arrest movement of the holding member relative to the shaft in a position where the targets cannot pass through the opening. A restraining mechanism prevents all but the lowermost target in each column from passing through the transfer opening, as the columns pass above the transfer opening.

27 Claims, 8 Drawing Sheets

TARGET MAGAZINE

This application is a continuation of application Ser. No. 07/035,733 filed Mar. 26, 1987, now abandoned.

this invention relates to a target magazine.

More particularly, the invention relates to a target magazine for holding targets such as clay pigeons which are to be projected by a throwing device which throws or hurls the clay pigeons into the air so as to provide a target for a shooter.

The general object of the invention is to provide a magazine which can be made of relatively large capacity and yet is of simple and robust construction.

According to the present invention there is provided a magazine for targets to be thrown from a throwing device having a rotatable throwing arm, said magazine comprising a support means having a transfer opening therein, holding means for holding a plurality of columns of targets, the columns being supported by the support means except at the transfer opening, indexing means for rotating the holding means in synchronism with the throwing arm whereby when one of the columns passes over the transfer opening the lowermost target in the column passes through the opening and onto the throwing arm, said indexing means being arranged to arrest movement of the holding means in a position wherein the targets cannot pass through the opening, and restraining means for preventing all but the lowermost target in each column from passing through the transfer opening, as the columns pass above the transfer opening.

Preferably the holding means comprises a cage-like structure having a plurality of fingers for holding the targets in columns. Preferably there are N columns and the indexing means is arranged to rotate the cage through A degrees where A=360 divided by N. It is further preferred that the indexing means rotates the cage so that it has the same angle of velocity as the throwing arm when the throwing arm is adjacent to the transfer opening.

The invention also provides a device for throwing targets comprising a throwing arm and means for causing predetermined rotation of the throwing arm in combination with the magazine as defined above.

The invention will now be further described with reference to the accompanying drawings, in which.

Figure 4:
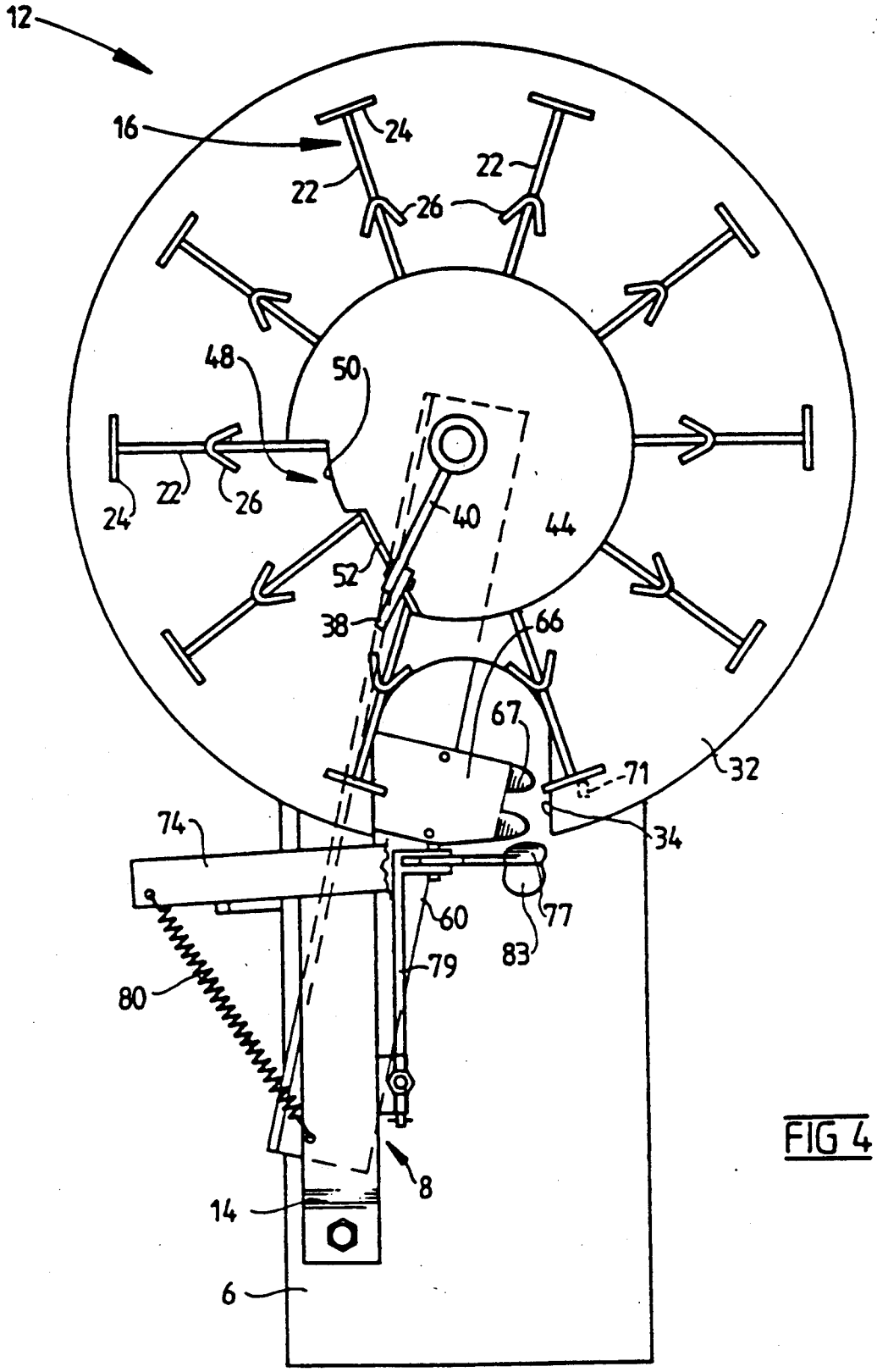
Figure 5:
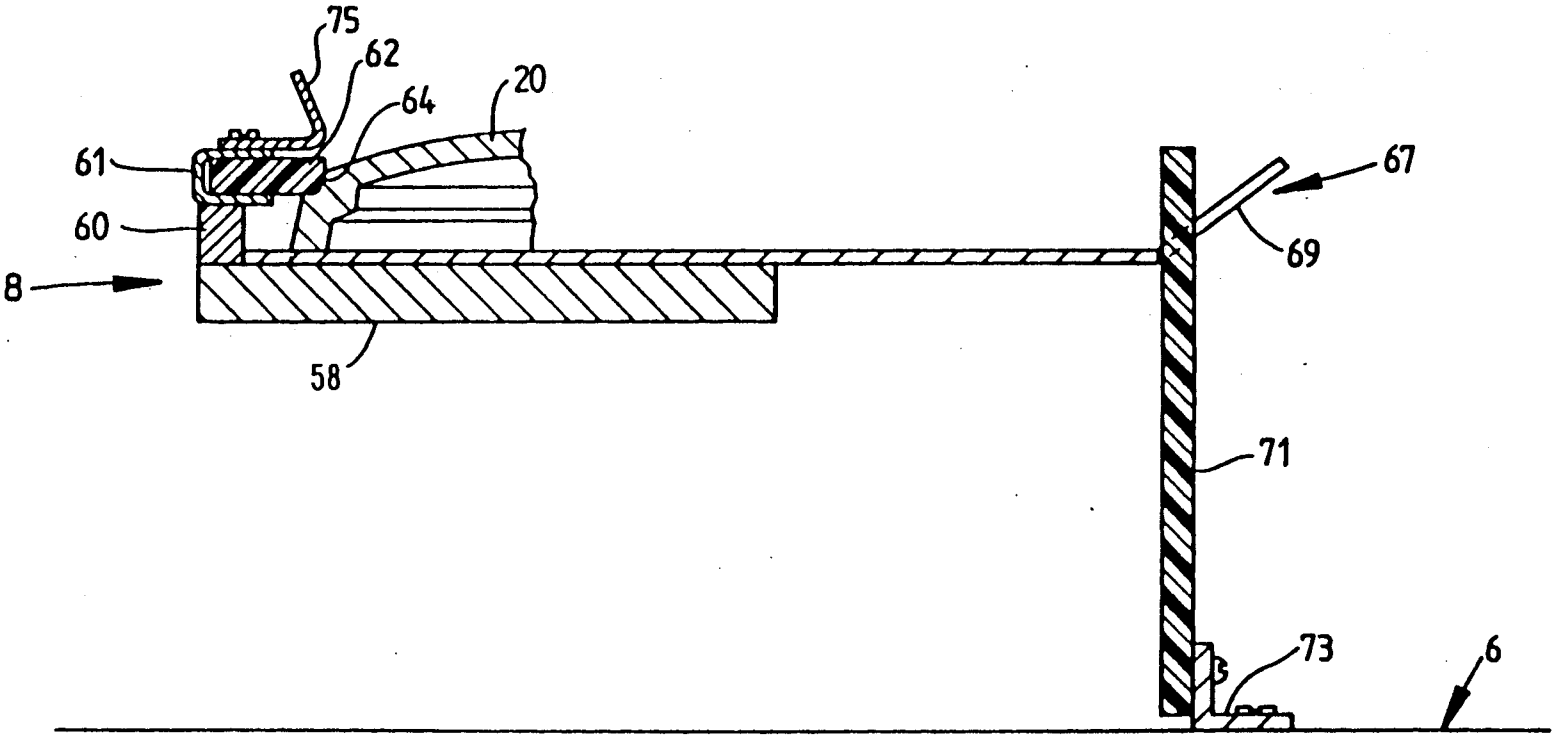
Figure 6:
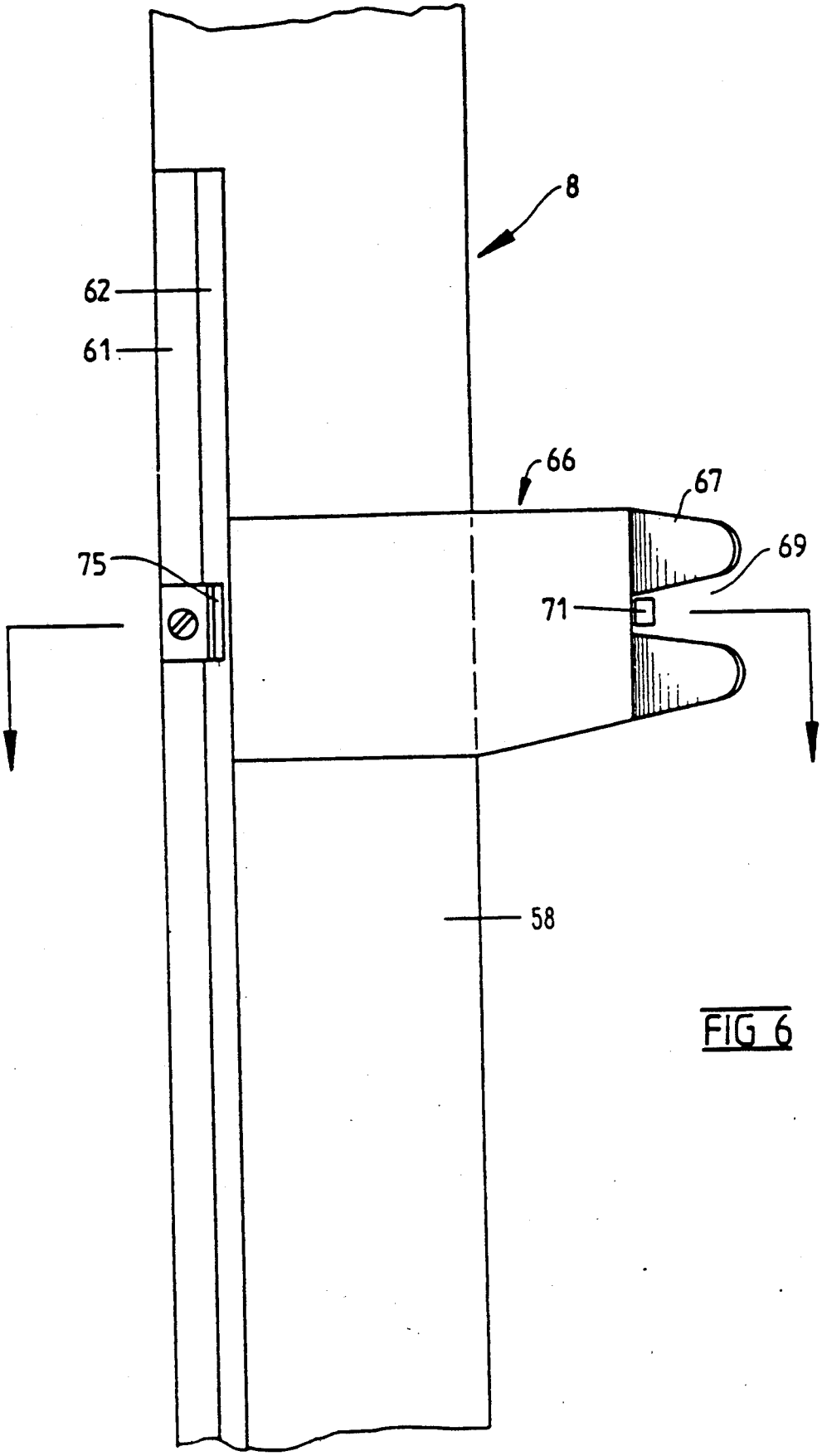
Figure 9:
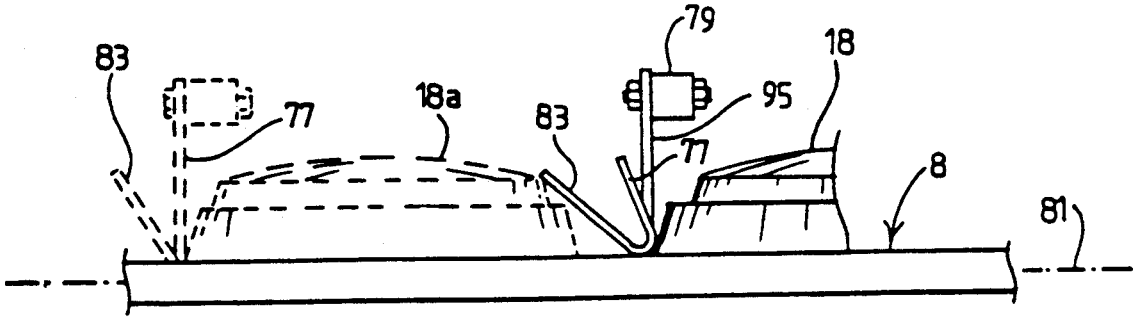
Figure 7:
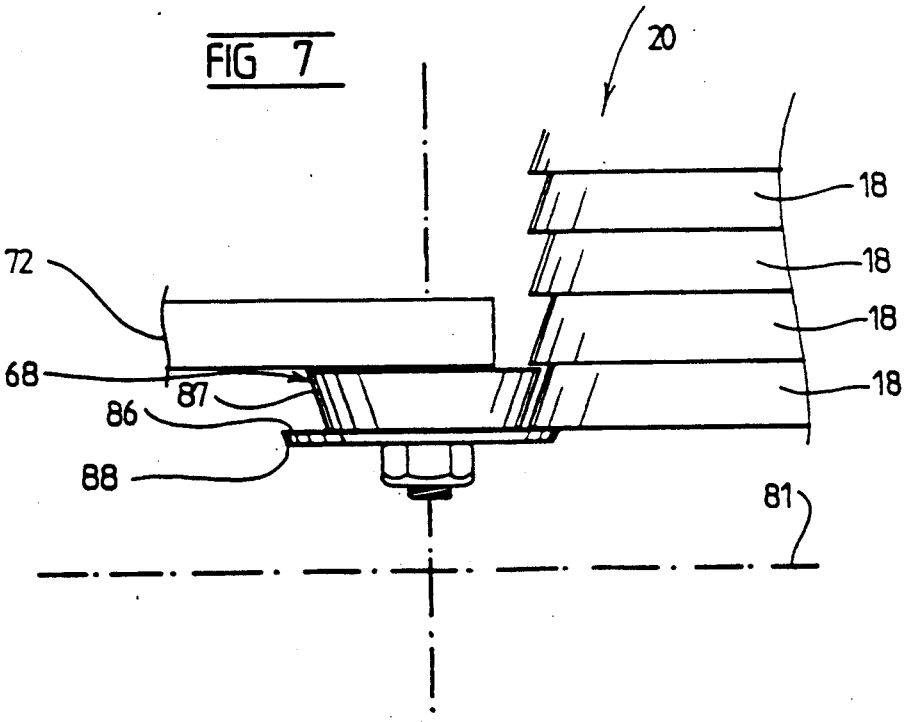
Figure 8:
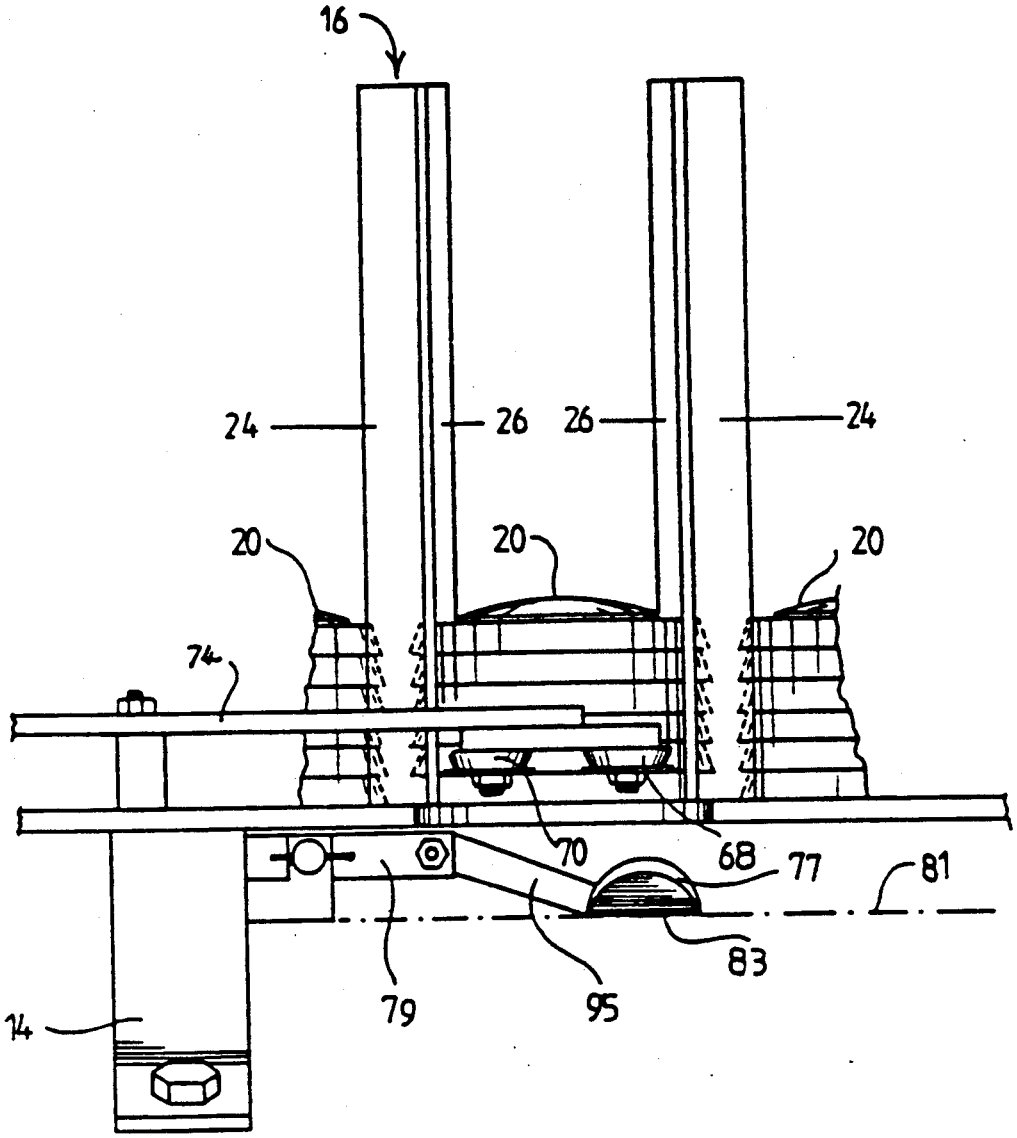

FIG. 4 is another schematic view of the device with the throwing arm located beneath the transfer opening, FIG. 5 is a schematic cross-sectional view of the throwing arm, FIG. 6 is a schematic plan view of the throwing arm, FIG. 7 is a more detailed side view of the restraining means for laterally supporting a column of clay pigeons, FIG. 8 is a side view showing a clay pigeon on the throwing arm, and FIG. 9 is a fragmentary side view of part of the device.

Figure 1:
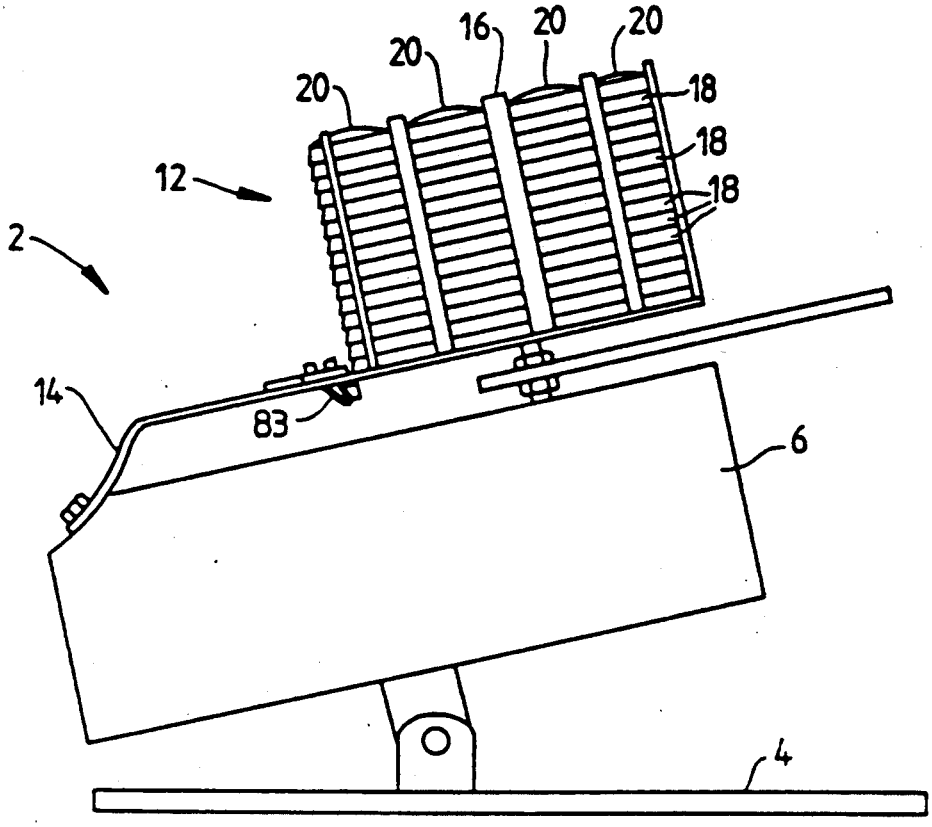
FIG. 1 is a simplified side view of a preferred embodiment of the invention.

The throwing apparatus 2 shown in FIG. 1 comprises a base 4 which mounts a throwing mechanism 6 having a throwing arm 8 mounted for rotation with a shaft 10. A magazine 12 in accordance with the invention is mounted above the mechanism 6 by means of a bracket 14 bolted to the housing of the mechanism 6. The magazine includes a cage structure 16 which holds the clay pigeons or targets 18 in a plurality of columns 20. In use of the apparatus, the mechanism 6 rotates the arm and during part of the cycle of rotation of the arm 8 one of the clay pigeons 18 is transferred to the arm. The arm then comes to rest until triggered by the user and a rapid throwing stroke is executed. The target rolls along the arm 8 and at the end thereof the target will be projected from the device. A new target can then be delivered to the arm in readiness for the next triggering.

Figure 2:
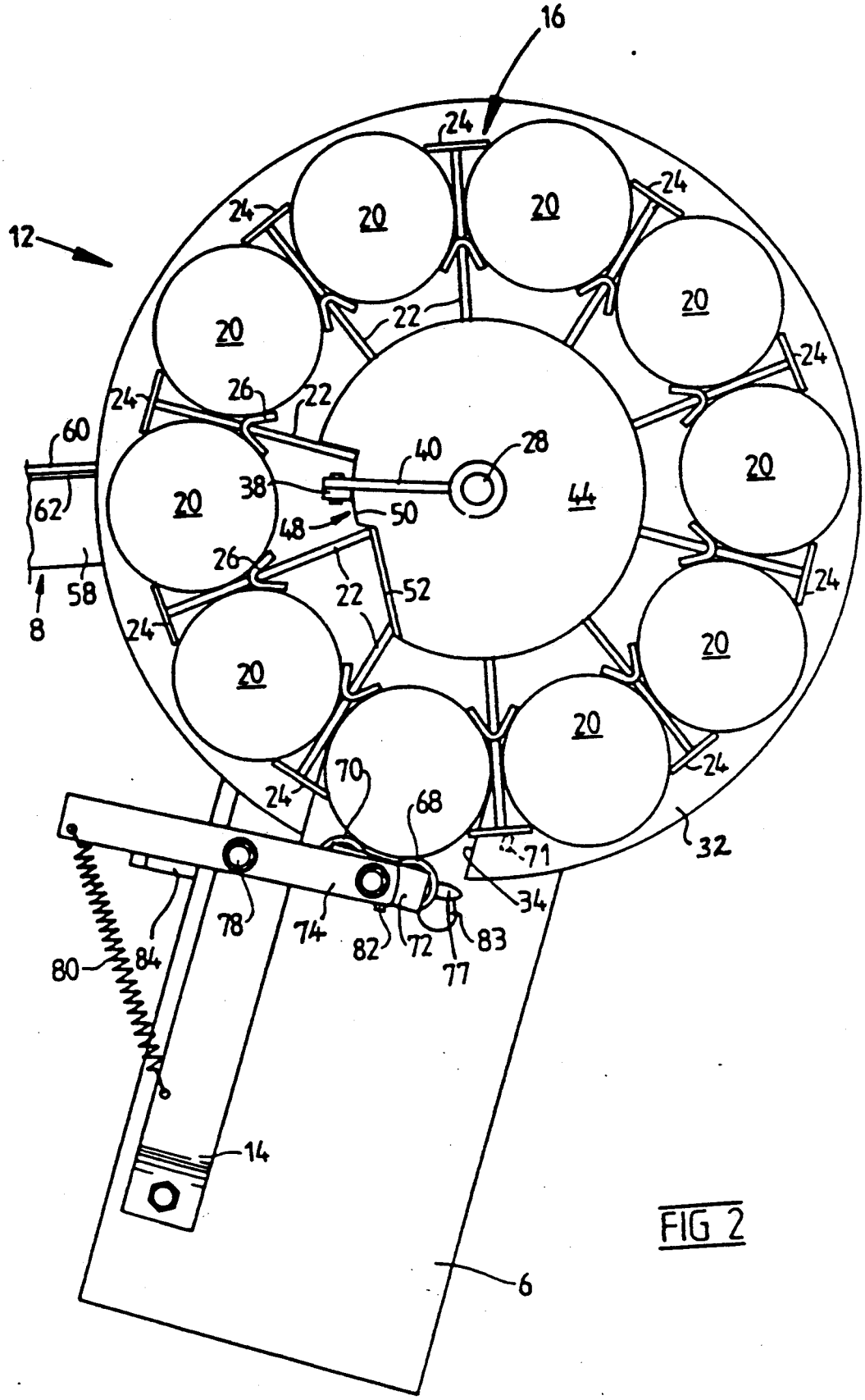
FIG. 2 is a schematic plan view of the device.
Figure 3:
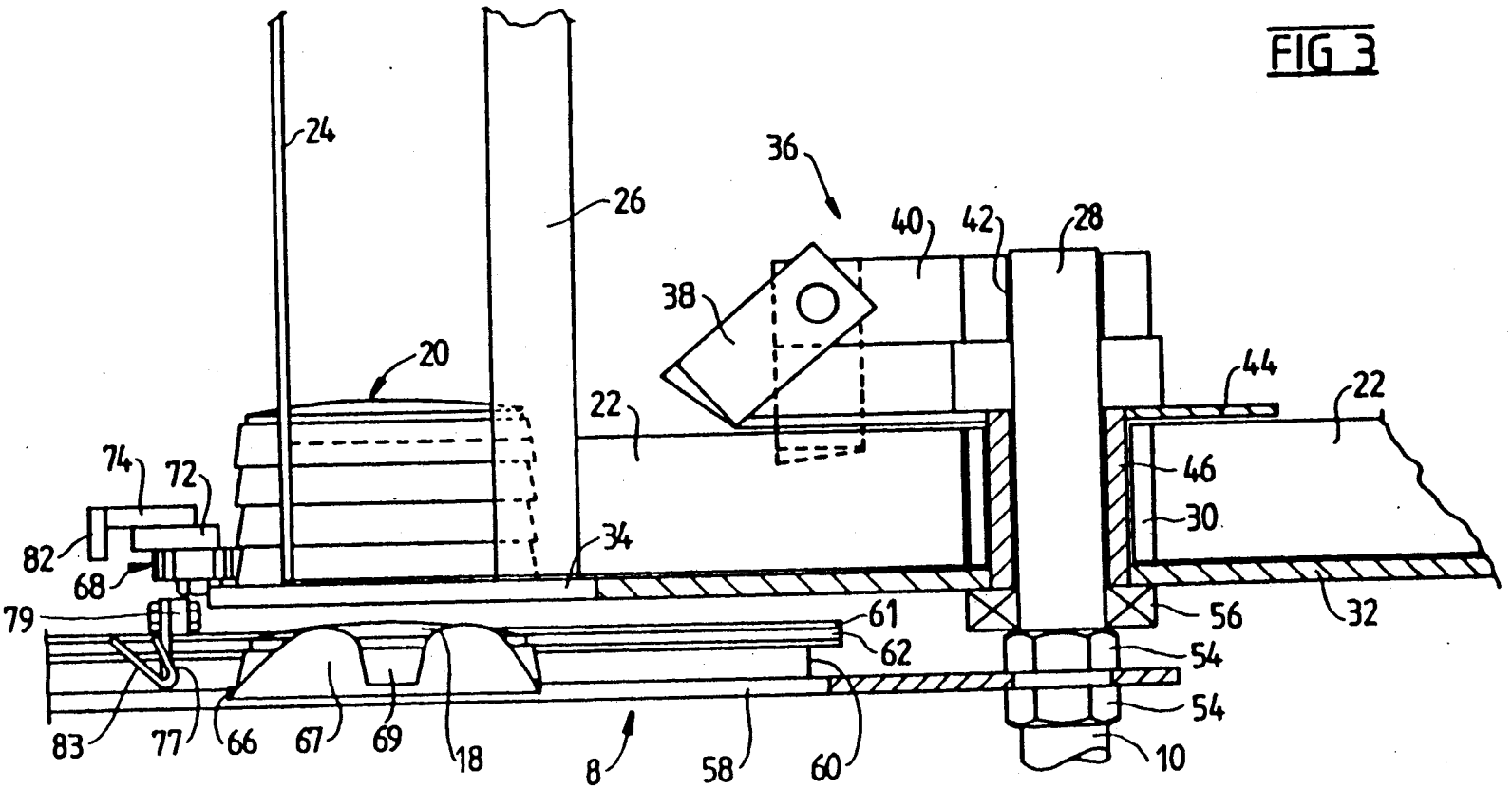
FIG. 3 is a schematic sectional view taken along the line 3—3.

The magazine 12 is more fully shown in FIGS. 2 to 4. The cage structure 16 comprises ten radial arms 22 having outer support plates 24 connected to their ends. Inner support fingers 26 extend upwardly from the arms 24, the arrangement being such that the edges of the fingers 26 and plates 24 define cages in which the columns 20 of targets are held.

As best seen in FIG. 3, the magazine 12 includes a shaft 28 which is connected for rotation with the shaft 10 of the throwing mechanism 6. The inner ends of the arms 22 are connected to a hub 30 through which the shaft 28 passes. The lower edges of the arms 22 bear against a base plate 32 which is connected to the bracket 14 and hence is stationary with respect to the housing of the throwing mechanism 6. The plate 32 includes a transfer opening 34 which permits individual targets 18 to pass therethrough so as to be received on the throwing arm 8, as will be described hereinafter. The magazine 12 includes indexing means 36 which comprises a driving cam 38 pivotally connected from an arm 40 which is connected for rotation with the shaft 28 by means of a key 42. The drive cam 38 is engageable with a stationary cam plate 44 which is carried by means of a bush 46 extending upwardly from the plate 32. The shaft 28 rotates in the anti-clockwise direction (as seen in FIG. 2) and the cam 38 will rotate therewith. The cam plate 48 will for most of the revolution of the shaft 28 engage the inner edge of the cam 38 and rotate it so that it is an oblique position as shown in solid lines in FIG. 3 in which case the lower edge of the cam 38 is above the level of the arms 22. Thus, in this position the cam 38 will not cause any rotational movement of the arms 22 and hence of the cage 16 holding the targets 20. The cam plate 44 has a cam recess 48 having a circular edge portion 50 and chord portion 52. When the cam member 38 encounters the cam recess 38, it will fall to a vertical position as seen in broken lines in FIG. 3 whereupon it will engage one of the arms 22 and so cause rotation of the cage 16 until the member 38 is again rotated out of engagement with the arms 22 by the end of the chord portion 52 of the cam recess 48. In the illustrated arrangement, there are 10 columns 20 of targets and therefore the cam recess 48 is shaped so that the cam driver 38 will cause the framework 16 to rotate through 36° during each full revolution of the shaft 28. Further, the cage 16 is arranged to come to rest in a position wherein none of the columns 20 is directly above the transfer opening 34 so that the lowermost targets 18 cannot pass therethrough.

It will be appreciated that in the driving position of the cam 38 there is a direct mechanical engagement with one of the arms 22 so that during the indexing stroke the rotational speed of the cage 16 will be the same as the shaft 28 and hence of the throwing arm 8. Thus, the target 18 which falls through the transfer opening 34 will have the same angular velocity as the throwing arm 8 thus ensuring that it will be correctly received by the throwing arm 8.

The width of the recess 34, as measured in the circumferential direction, is somewhat larger than the diameter of the target 18 so as to permit the target to fall through the opening without being fouled by the edges of the opening. The amount by which the opening exceeds the diameter of the target depends on the rotational velocity but typically it will be in the range 1.15 to 1.3 times the diameter of the target.

The throwing arm 8 is mounted on the shaft 10 by means of nuts 54 and is rotatable just beneath the plate 32. A thrust bearing 56 is located between the upper nut 54 and the underside of the plate 32 so as to assist in supporting the plate cage and targets.

As best seen in FIGS. 5 and 6, the throwing arm 8 has a base portion 58 and flange 60 which carries a channel member 61 which receives a strip 62 of resilient material so as to provide good frictional contact with the target 18. The target is provided with a recessed edge 64 which engages the strip 62 so as to have snug frictional engagement therewith. During rotation of the arm during the throwing stroke the target 62 rolls along the arm with the rebated edge 64 in contact with the strip 62. The throwing arm is provided with a support plate 66 having an upwardly inclined leading edge 67, which prevents the target 18 from falling forwardly of the leading edge of the arm during the transfer through the transfer opening 34. The leading edge 67 has a recess 69 which during rotation receives a resilient finger 71. The finger 71 will engage any target 20 which is located forwardly on the support plate 66 and cause it to move backwardly into contact with the strip 62. After this action the finger 71 will be deflected downwardly by the arm 8 as it continues its rotation. The finger 71 is carried by a bracket 73 mounted on the housing 6.

The trailing edge of the arm 8 is provided with a plate 75 which is mounted on the channel member 61. The plate 75 will assist in bringing into correct registry with the support plate 66 and strip 62 any target 18 which is displaced towards the rear edge of the arm 8 as it falls through the opening 34.

The magazine is provided with plate 77 which is mounted on an arm 98 which in turn is pivotally connected to an arm 79 which projects from the bar 14. The plate 77 prevents sliding movements of the target 18 down the throwing arm 8, which rotates in a downwardly inclined plane 81, as seen in FIG. 9. In a preferred form, the device is capable of throwing two targets 18 and **18*a* similtaneously. In this case the first target 18 is delivered normally from the magazine 16 and the second target 18*a* is placed manually on the throwing arm 8 by an operator. The position of the plate 77 is moved to the position shown in broken lines in FIG. 9 by adjusting the position of the support arm relative to the housing 6. The plate 77 is preferably provided with an inclined projection 83 which enables the operator to deflect the plate 77 upwardly with the inserting movement of the second target 18*a*. The plates 77 and 83 will then fall under gravity and engage the arm 8 and will thus prevent downward sliding of the targets 18 and 18*a* at least whilst the arm 8 is beneath the transfer recess 34**.

The magazine is provided with restraining means for preventing all of the targets 18 in a column from passing through the opening 34, except for the lowermost target. In the illustrated arrangement, the restraining means comprises two rollers 68 and 70 which are resiliently biased to engage the second bottom target in the column, as illustrated diagramatically in FIGS. 3, 7 and 8. The rollers 68 and 70 bias the second bottom target in the column radially inwardly so that it is clamped against the fingers 26 and so holds up the whole column 20 until the column has been moved by the cage 16 to a position in which the column is no longer directly above the transfer opening 34 and thus the targets in the column cannot pass through the opening since they will engage the plate 32. The rollers 68 and 70 are carried by a plate 72 which is pivotally connected to an arm 74 at pivot point 76. The arm 74 is itself pivotally connected to the bracket 14 at pivot point 78. A tension spring 80 acts between the end of the arm 74 and the bracket 14 so as to bias the arm 74 towards rotation in an anti-clockwise direction. This tends to force the roller 68 and 70 into engagement with the target 18 as mentioned previously. As the cage 16 moves, the second lowermost target in the column which is above the opening in the plate 34 will be engaged by the rollers and will be maintained in engagement therewith because of the action of the spring 80 and the pivotal mounting of the plate 72 on the arm 74. An abutment 82 is provided on the arm 74 so as to prevent excessive rotation of the plate 72 relative to the arm. A further abutment 84 is provided on the bracket 14 so as to prevent excessive rotation of the arm 74.

The lower edges of the rollers 68 and 70 have projecting flanges 86 which have inclined faces 88 on their lower sides. As seen in FIG. 7 the flanges 86 will support the lower edges of the lowermost target remaining in the column 20. The flanges 86 also serve to separate the lowermost target from the target above it. The inclined faces 88 form sharp outer edges for the flanges so as to facilitate penetration of the flanges between targets. Further, it is preferred that the curved faces 87 of the rollers are frusto-conical so as to be complementary to adjacent faces on the targets 20, as seen in FIG. 7. The apex angle of the conical surface of which the faces 87 form part would normally be about 10°.

It will be seen that the action of the restraining rollers 68 and 70 constitute a very simple but effective technique for ensuring that only one of the targets 18 falls through the opening 34 as the magazine indexes that column across the opening.

The magazine can be arranged to hold, for example, 250 targets and can be operated relatively quickly so that all of them can be discharged in, for example, 20 minutes which is a relatively rapid rate of discharge.

Many modifications will be apparent to those skilled in the art without departing from the spirit and scope of the invention.

I claim:

1. A throwing device for throwing targets said device including a throwing arm mounted to a single shaft means for rotation therewith, means for selectively rotating the throwing arm, and a magazine for holding a plurality of columns of targets, the magazine including a cage structure which holds the targets in said columns and support means including an opening through which the targets can pass to the throwing arm, said cage structure being mounted to said single shaft means for rotation about said single shaft means and indexing means for causing indexed rotation of said cage structure about said single shaft means, said indexing means including a first cam member which is carried by said support means and located in a fixed position above the support means and a second cam member which is coupled to said single shaft means for rotation in unison therewith, the cam members cooperating with one another such that the second cam member engages the cage structure and rotates it through a predetermined angle during an indexing stroke.

2. A magazine (12) for targets (18) to be thrown from a throwing device (6) having a rotatable throwing arm (8) mounted for rotation with a shaft (10), said magazine comprising a support means (32) having a transfer opening (34) therein, holding means (16) for holding a plurality of columns (20) of targets, the columns being supported by the support means (32) except at the transfer opening, indexing means (38, 22, 50) for selectively rotating the holding means (16) about the shaft in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft in a position wherein the targets cannot pass through the opening, restraining means (68, 70, 26) for preventing all but the lowermost target in each column from passing through the transfer opening, as the columns pass above the transfer opening, and wherein the indexing means includes a cam plate (44) which is stationary relative to said support means (32) and located above said support means (32) and between the columns (20) of targets, a cam member (38) which, in use, is coupled to the shaft (10) and is movable with the throwing arm (8), the arrangement being such that the cam plate prevents the cam member from contacting the holding means (16) except during an indexing stroke of the indexing means in which the cam member engages the holding means and rotates the holding means through a predetermined angle.

3. A magazine as claimed in claim 2 wherein said shaft means, (10,28) includes a shaft (28) which is, in use, rotated with the throwing device (6), the holding means being mounted for rotation with said shaft (28).

4. A magazine as claimed in claim 2 wherein the holding means (28) comprises a cage structure (16) rotatably mounted on single shaft means.

5. A magazine as claimed in claim 2 wherein the cage structure comprises a hub (30), a plurality of radial arms (22), and uprights (24, 26) which project upwardly from the radial arms.

6. A magazine as claimed in claim 2 wherein the restraining means (68, 70, 26) includes means to bias the second lowermost target in column (20) which is above the transfer opening (34) into engagement with the holding means (16).

7. A magazine as claimed in claim 6 wherein the restraining means includes at least one roller (68, 70) which, in use, engages the periphery of said second lowermost target.

8. A magazine as claimed in claim 2 including a target abutting member (77) to prevent radial slipping of the target on the throwing arm (8).

9. A magazine as claimed in claim 2, wherein the width of the transfer opening, as measured tangentially to the direction of movement of the throwing arm (8), is 1.15 to 1.3 times the diameter of the targets (18).

10. A magazine as claimed in claim 2 in combination with said throwing device (6) and wherein the shaft means (10, 28) includes a rotatable shaft (10) upon which said throwing arm (8) is mounted.

11. A magazine (12) for targets (18), according to claim 2, wherein said support means (32) comprises a stationary plate and the columns are supported by the stationary plate (32) except at the transfer opening.

12. A magazine (12) for targets (18), according to claim 2, wherein said shaft means (10, 28) comprises single shaft means.

13. A throwing device for throwing targets, said device including:

(a) a throwing arm mounted to a single shaft means for rotation therewith;

(b) means for selectively rotating the throwing arm; and (c) a magazine for holding a plurality of columns of targets, the magazine including a cage structure which holds the targets in said columns and a stationary support plate including a single opening through which the targets can pass to the throwing arm, all of said columns being continuously and directly supported by the stationary support plate except at said opening, wherein said cage structure is mounted to said single shaft means for rotation about said single shaft means, and indexing means for causing indexed rotation of said cage structure about said single shaft means, said indexing means including a first cam member which is carried by said stationary support plate and is fixed in position relative thereto, and a second cam member which is coupled to said single shaft means for rotation in unison therewith said second cam member being in operating engagement with said first cam member, the second cam member being operable to engage said cage structure and rotate it through a predetermined angle during an indexing stroke.

14. A magazine as claimed in claim 13 wherein the cage structure comprises a hub (30), a plurality of radial arms (22), and uprights (24, 26) which project upwardly from the radial arms.

15. A throwing device as claimed in claim 13, wherein the first cam member comprises a cam plate having an opening therein through which said single shaft means passes.

16. A throwing device as claimed in claim 15, wherein said cam plate is located above said stationary support plate.

17. A throwing device as claimed in claim 15 or 16, wherein a second cam member includes an arm which projects from said single shaft means and a link pivotally connected thereto, said link being in engagement with a cam surface on said cam plate.

18. A throwing device as claimed in claim 17, wherein the cage structure includes a hub through which said single shaft means passes and a plurality of support arms extending therefrom, the cam plate being operable to elevate said link above said support arms except during said indexing stroke whereupon said link is lowered into engagement with one of said support arms for rotating the cage structure with said link through said predetermined angle.

19. A magazine (12) for targets (18), comprising a throwing device (6) from which the targets are thrown and having a rotatable throwing arm (8) mounted to shaft means (10, 28), said magazine comprising support means (32) having a transfer opening (34) therein, holding means (16) mounted to said shaft means for holding a plurality of columns (20) of targets, all of the columns being supported by the support means (32) except at the transfer opening, indexing means (38, 22, 50) mounted to said shaft means for selectively rotating the holding means (16) about said shaft means in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft means in a position wherein the targets cannot pass through the opening, and restraining means (68, 70, 26) for preventing all but the lowermost target in each column from passing through the transfer opening, as the columns pass above the transfer opening, wherein the restraining means (68, 70, 26) includes means to bias the second lowermost target in column (20) which is above the transfer opening (34) into engagement with the holding means (16), wherein the restraining means includes at least one roller (68, 70) which, in use, engages the periphery of said second lowermost target, and wherein there are two rollers (68, 70) mounted on a roller support plate (72) which is pivotally connected to a biasing arm (74) which is resiliently biased relative to the throwing device 6 such that the roller support plate is biased towards the column of targets above the transfer opening (34).

20. A magazine as claimed in claim 19 wherein each roller (68, 70) is provided with a flange (86) adjacent its lower edge, and wherein said second lowermost target is supported by the flanges (86) as it passes above the transfer opening.

21. A magazine as claimed in claim 20 wherein the outer edges of the flanges (86) are narrow whereby the flanges will penetrate a gap between the lowermost and second lowermost targets and thus facilitate separation of the former from the latter.

22. A magazine (12) for targets (18), comprising a throwing device (6) from which the targets are thrown and having a rotatable throwing arm (8) mounted to shaft means (10, 28), said magazine comprising support means (32) having a transfer opening (34) therein, holding means (16) mounted to said shaft means for holding a plurality of columns (20) of targets, all of the columns being supported by the support means (32) except at the transfer opening, indexing means (38, 22, 50) mounted to said shaft means for selectively rotating the holding means (16) about said shaft means in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft means in a position wherein the targets cannot pass through the opening, and restraining means (68, 70, 26) for preventing all but the lowermost target in each column from passing through the transfer opening, as the columns pass above the transfer opening, in combination with said throwing device (6) and wherein the shaft means (10, 28) includes a rotatable shaft (10) upon which said throwing arm (8) is mounted for rotation therewith, wherein the throwing arm (8) includes a target support plate (66) having an upturned leading edge (67), wherein said leading edge (67) includes a recess (69) and said finger (71) extends into the recess prior to being deflected by said target support plate (66).

23. A magazine as claimed in claim 22 including a target deflecting member (75) mounted near the trailing edge of the throwing arm (8) for directing rearwardly displaced targets forwardly so as to be correctly seated on the throwing arm.

24. A magazine (12) for targets (18), comprising a throwing device (6) from which the targets are thrown and having a rotatable throwing arm (8) mounted to shaft means (10, 28), said magazine comprising support means (32) having a transfer opening (34) therein, holding means (16) mounted to said shaft means for holding a plurality of columns (20) of targets, all of the columns being supported by the support means (32) except at the transfer opening, indexing means (38, 22, 50) mounted to said shaft means for selectively rotating the holding means (16) about said shaft means in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft means in a position wherein the targets cannot pass through the opening, and restraining means (68, 70, 26) for preventing all but the lowermost target in each column from passing through the transfer opening, as the columns pass above the transfer opening, in combination with said throwing device (6) and wherein the shaft means (10, 28) includes a rotatable shaft (10) upon which said throwing arm (8) is mounted for rotation therewith, wherein the throwing arm (8) includes a target support plate (66) having an upturned leading edge (67), including a target deflecting member (75) mounted near the trailing edge of the throwing arm (8) for directing rearwardly displaced targets forwardly so as to be correctly seated on the throwing arm.

25. A magazine (12) for targets (18) to be thrown from a throwing device (6) having a rotatable throwing arm (8) mounted for rotation with a shaft (10), said magazine comprising support means (32) having a transfer opening (34) therein, holding means (16) for holding a plurality of columns (20) of targets, the columns being supported by the support means (32) except at the transfer opening, indexing means (38, 22, 50) for selectively rotating the holding means (16) about the shaft in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft in a position wherein the targets cannot pass through the opening, and restraining means (68, 70, 26) for preventing all but the lowermost target in each column from passing through the transfer opening, as the columns pass above the transfer opening;

wherein the throwing arm (8) includes a target support plate (66) having an upturned leading edge (67); and wherein a resilient finger (71) extends into the path of movement of the target on the throwing arm (8) so as to push the target into engagement with a resilient strip (62) at the trailing edge of the throwing arm (8), wherein said leading edge (67) includes a recess (69) and said finger (71) extends into the recess prior to being deflected by said target support plate (66).

26. A magazine (12) for targets (18) to be thrown from a throwing device (6) having a rotatable throwing arm (8) mounted for rotation with a shaft (10), said magazine comprising support means (32) having a transfer opening (34) therein, holding means (16) for holding a plurality of columns (20) of targets, the columns being supported by the support means (32) except at the transfer opening, indexing means (38, 22, 50) for selectively rotating the holding means (16) about the shaft in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft in a position wherein the targets cannot pass through the opening, and restraining means (68, 70, 26) for preventing all but the lowermost target in each column from passing through the transfer opening, as the columns pass above the transfer opening;

wherein the throwing arm (8) includes a target support plate (66) having an upturned leading edge (67); and wherein a resilient finger (71) extends into the path of movement of the target on the throwing arm (8) so as to push the target into engagement with a resilient strip (62) at the trailing edge of the throwing arm (8), including a target deflecting member (75) mounted near the trailing edge of the throwing arm (8) for directing rearwardly displaced targets forwardly so as to be correctly seated on the throwing arm.

27. A magazine (12) for targets (18) to be thrown from a throwing device (6) having a rotatable throwing arm (8) mounted for rotation with a shaft (10), said magazine comprising support means (32) having a transfer opening (34) therein, holding means (16) for holding a plurality of columns (20) of targets, the columns being supported by the support means (32) except at the transfer opening, indexing means (38, 22, 50) for selectively rotating the holding means (16) about the shaft in synchronism with the throwing arm (8) whereby when one of the columns (20) passes over the transfer opening (34) the lowermost target (18) in the column passes through the opening and onto the throwing arm, said indexing means being arranged to arrest movement of the holding means relative to the shaft in a position wherein the targets cannot pass through the opening, and restraining means (68, 70, 26) for preventing all but the lowermost target in each column from passing through the transfer opening, as the columns pass above the transfer opening;

wherein the restraining means (68, 70, 26) includes means to bias the second lowermost target in column (20) which is above the transfer opening (34) into engagement with the holding means (16);

wherein the restraining means includes at least one roller (68, 70) which, in use, engages the periphery of said second lowermost target; and wherein there are two rollers (68, 70) mounted on a roller support plate (72) which is pivotally connected to a biasing arm (74) which is resiliently biased relative to the throwing device 6 such that the roller support plate is biased towards the column of targets above the transfer opening (34).

* * * * *